United States Patent [19]
Chandler et al.
[11] 4,238,874
[45] Dec. 16, 1980

[54] TOOLING WITH STEPPING MOTOR DRIVE

[75] Inventors: William B. Chandler, Winston-Salem; John D. Davis, Lexington; Ronald G. Sergeant, Winston-Salem, all of N.C.

[73] Assignee: AMP Incorporated, Harrisburg, Pa.

[21] Appl. No.: 929,742

[22] Filed: Jul. 31, 1978

[51] Int. Cl.[3] ..... H01R 43/04

[52] U.S. Cl. ..... 29/33 M; 29/749; 29/753

[58] Field of Search ..... 29/749, 753, 754, 566.1, 29/33 M, 750, 751, 752; 269/157, 238

[56] References Cited

U.S. PATENT DOCUMENTS

| | | | |
|---|---|---|---|
| 2,579,878 | 12/1951 | Stone | 269/157 X |
| 3,838,491 | 10/1974 | Mayberry et al. | 29/749 |
| 3,968,555 | 7/1976 | Holt | 29/749 X |
| 4,034,472 | 7/1977 | Cover et al. | 29/749 |
| 4,048,710 | 9/1977 | Nijman | 29/753 X |

*Primary Examiner*—Z. R. Bilinsky
*Attorney, Agent, or Firm*—Gerald K. Kita

[57] ABSTRACT

Apparatus is disclosed which includes a carriage having mounted thereon tooling for trimming wires and inserting trimmed wires into electrical contacts successively along an electrical connector mounted on an anvil. A stepping motor drive transports and repeatedly stops the carriage and the tooling successively in alignment with the multiple contacts preparatory to insertion of corresponding trimmed wires therein. The tooling is quickly replaceable and follows along a reference surface of the connector for positive alignment with the contacts.

11 Claims, 18 Drawing Figures

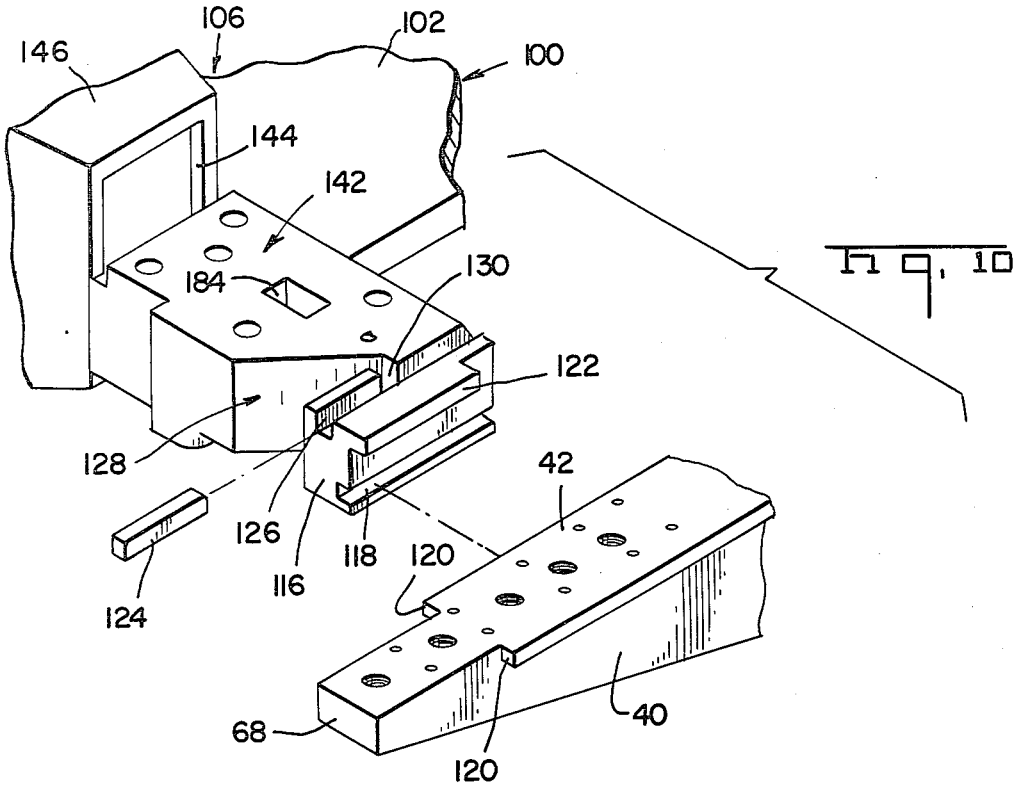
Fig. 10
Fig. 9
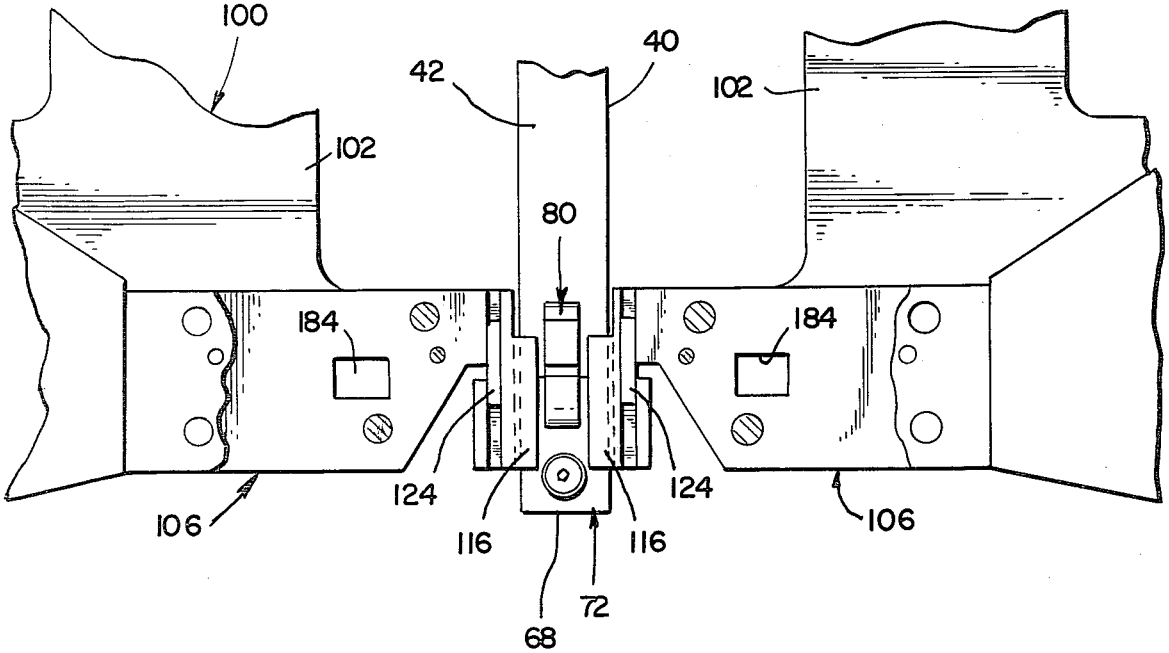

TOOLING WITH STEPPING MOTOR DRIVE

FIELD OF THE INVENTION

The invention relates to motor driven apparatus by which an operator may connect the insulated wires of a multiple wire cable into multiple contacts of an electrical connector, the operator presenting pairs of wires to the apparatus which trims the wires, inserts the trimmed wires into corresponding electrical contacts and indexes successively in alignment with the multiple contacts preparatory to insertion of corresponding trimmed wires therein.

BACKGROUND

Apparatus embodying this invention is useful for connecting multiple wires to a connector such as that disclosed and claimed in U.S. Pat. No. 3,760,335. Such a connector includes two parallel rows of slotted contacts having wire-receiving portions into which are received and connected insulation covered wires of a multiple wire cable.

A semi-automatic apparatus for trimming the insulated wires and inserting the trimmed wires into the contacts is disclosed in U.S. Pat. No. 3,995,358. In operation, an operator selects pairs of wires of the cable and presents the same to the apparatus. The apparatus has two reciprocating inserters which trim the pair of presented wires and insert the trimmed wires into corresponding contacts, one in each of the two rows of contacts. The inserters are permanently mounted a fixed distance apart for accommodating therebetween the above identified connector. A motor drive successively advances or transports the connector past the stationary inserters. In doing so, the connector slidably traverses over a work station which conforms closely to the connector profile thereby insuring that the connector is precisely aligned with the stationary inserters. Because the inserters have the conforming work station, they must be carefully positioned in the apparatus. A quick replacement or adaptation of the apparatus to accommodate different connectors is difficult.

BRIEF DESCRIPTION

Apparatus according to the present invention includes a work station in the form of an anvil having heel blocks for frictionally retaining a desired type of connector. The apparatus further includes a block which is transported by a stepping motor drive. A carriage is removably fastened to the block for transport therewith. The carriage has mounted thereon tooling for trimming wires and inserting the trimmed wires into electrical contacts mounted successively along the electrical connector retained on the anvil. The stepping motor drive transports and repeatedly stops the carriage, and thereby the tooling, successively in alignment with the contacts preparatory to insertion of corresponding wires therein. The carriage initially is at rest on the anvil without being fastened thereto and before mounting a connector on the anvil. The carriage then rides up and follows along a reference surface on the connector for positive alignment with successive contacts. The carriage is thereby lifted away from resting engagement on the anvil. The connector is sandwiched between the follower surface and the anvil. The carriage and the tooling is suitable for quick replacement as a unit, in that the carriage is readily unfastened from the block and readily separable from the anvil without having been fastened thereto.

OBJECTS

Accordingly, an object of the present invention is to provide apparatus for trimming wires and inserting trimmed wires into electrical contacts mounted successively along an electrical connector by apparatus including, an anvil having heel blocks supporting an electrical connector and a stepping motor drive which transports and repeatedly stops a carriage and inserter tooling unit successively in alignment with the contacts preparatory to insertion of the trimmed wires.

Another object of the present invention is to provide apparatus including, an anvil supporting an electrical connector, a quickly replaceable unit comprising a carriage and inserter tooling for trimming wires and inserting trimmed wires into electrical contacts mounted successively along the electrical connector and a stepping motor drive which transports the carriage along a surface of the connector to align the inserter tooling successively in turn with the contacts of the connector.

Another object of the present invention is to provide a readily replaceable unit for apparatus which trims and inserts wires into electrical contacts of a connector mounted on a work station having heel blocks which also are readily replaceable.

Another object of the present invention is to provide apparatus for trimming and inserting wires into electrical contacts of a connector with a cable clamp including first and second pivotally mounted levers having yokes at their ends which are pivotally displaced on intersecting arcuate paths to frictionally engage opposed sides of a multiple wire cable, the levers being frictionally locked wedgingly between the cable and the pivots and the connector being frictionally retained heel blocks, the cable and the connector being removable as a unit by drawing the same from the yokes and the heel blocks overcoming the frictional retention provided thereby.

Other objects and advantages of the present invention will become apparent from the following detailed description taken in conjunction with the accompanying drawings.

FIG. 3 is an enlarged perspective with parts in exploded configuration illustrating a work station in the form of an anvil having connector supporting heel blocks and a clamp for a multiple wire cable.

FIG. 5 is a longitudinal section taken along the line 5—5 of FIG. 1 and further illustrating the anvil, the carriage, and the stepping motor drive.

FIG. 8 is an enlarged plan view of a portion of the anvil illustrated in FIG. 7 and designated as being taken along the line 8—8 of FIG. 7.

FIG. 9 is an enlarged plan of a portion of the anvil and a portion of the carriage which is shown in a connector loading position initially resting on the anvil prior to mounting a connector thereon.

FIG. 10 is a fragmentary perspective with parts in exploded configuration illustrating the anvil and a portion of the carriage which initially rests on the anvil in a connector loading position.

FIG. 13 is a front elevation in section taken along the line 13—13 of the apparatus shown in FIG. 12 illustrating a multi-conductor cable with a pair of wires thereof positioned in the wire trimming and wire inserting tooling of the apparatus.

DETAILED DESCRIPTION

Figure 1:
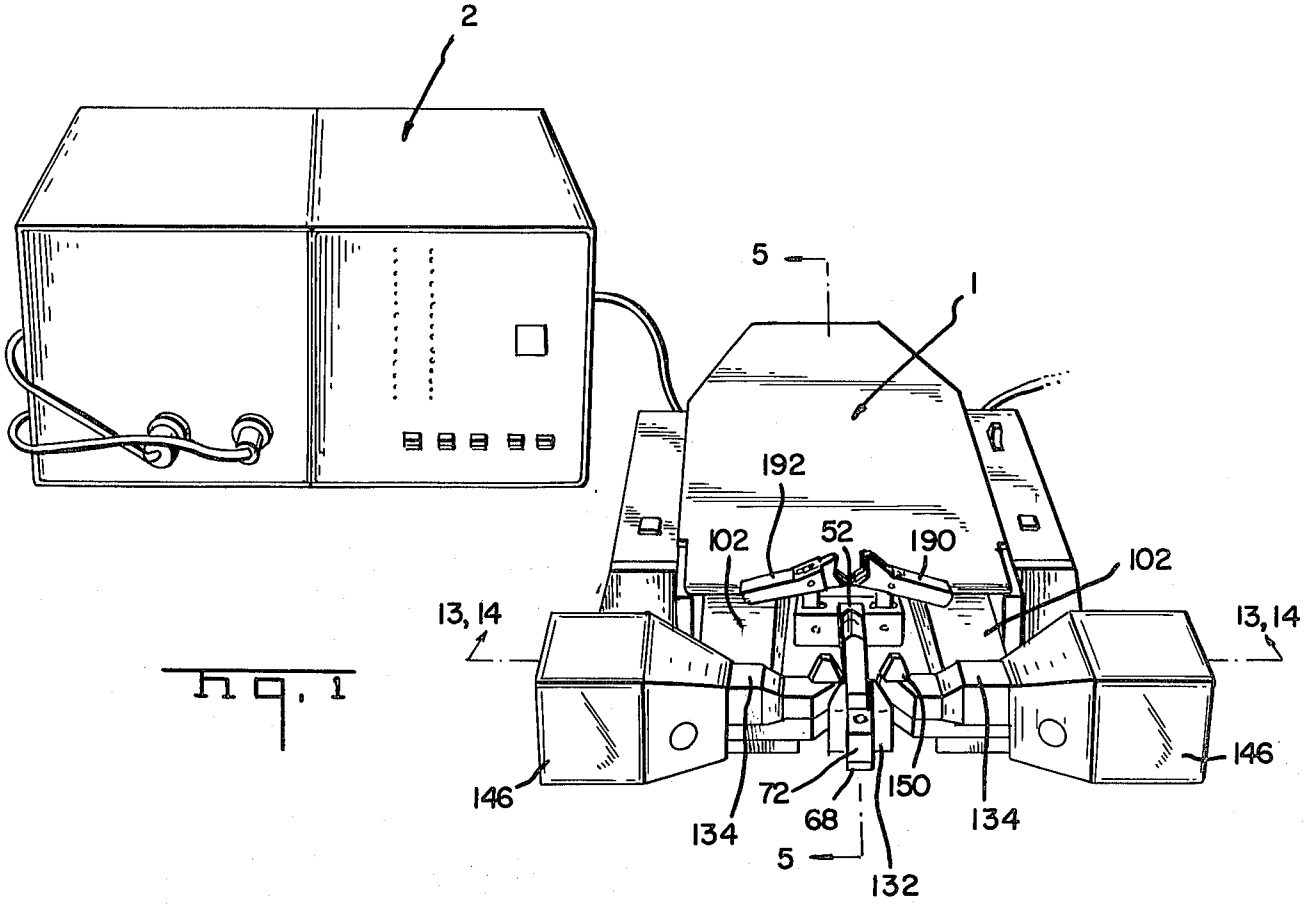
FIG. 1 is a perspective of apparatus according to the present invention.
Figure 2:
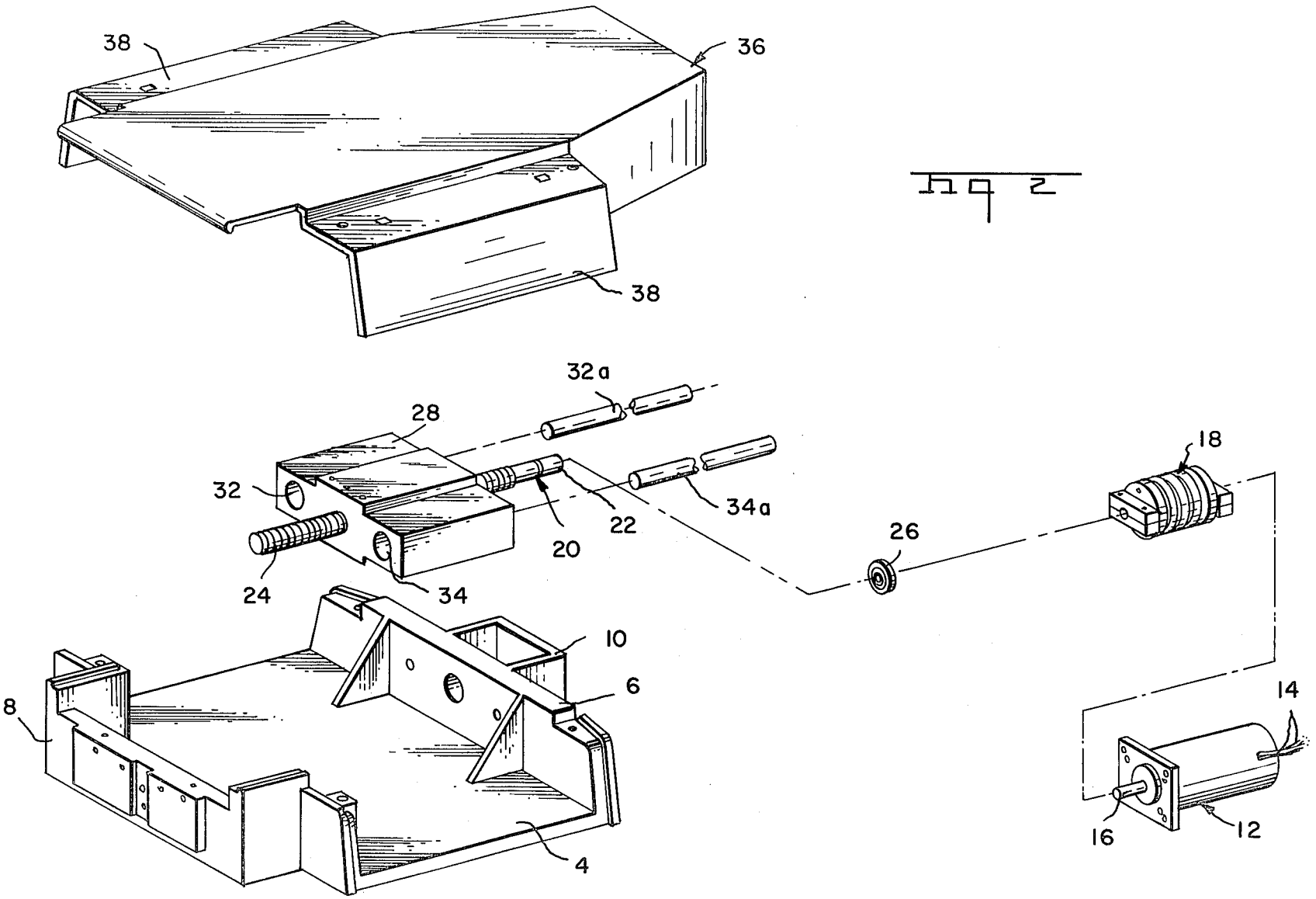
FIG. 2 is a perspective with parts in exploded configuration illustrating a stepping motor drive, a housing and a cover of the preferred embodiment shown in FIG. 1.

With more particular reference to FIG. 1 of the drawings, an electrically powered apparatus is generally indicated at 1 by which pairs of insulated wires of a multiple wire cable are successively trimmed and inserted into corresponding electrical contacts contained in an electrical connector, the apparatus further indexing successively in alginment with the multiple contacts preparatory to insertion of corresponding trimmed wires therein. Since all operations are activated electrically, such operations can be monitored electrically and displayed in a programming and mode indicating instrument or equipment 2. The apparatus 1 itself is an assembly of component parts. FIG. 2 illustrates some of the parts, such as, a base 4 having spaced outer end walls 6 and 8. The end wall 6 is provided with an external rectangular box enclosure 10, shown more particularly in FIG. 5 as having mounted therein an electrically powered stepping motor 12 having electrical power leads 14 for supplying electrical power for driving the motor, and a rotatable output shaft 16 which is connected rotatably in one end of a precision coupler 18 which assures precision alignment of the output shaft 16 with a rotatably driven elongate lead screw 20, one end 22 of which is journaled for rotation in a bearing 26 which, in turn, is mounted in and supported by the end wall 6. In addition, the lead screw end 22 is coupled for rotation in the remaining end of the coupler 18. The lead screw 20 bridges between the end wall 6 and the end wall 8 in which an opposite end 24 of the lead screw is journaled for rotation. A drive block 28 having an internally threaded bore 30 threadably receives the lead screw therethrough. The drive block 28 further is provided with a pair of bushing lined bores 32 and 34 parallel to the bore 30 for slidably receiving cylindrical guide rails 32*a* and 34*a*. The guide rails 32*a* and 34*a* bridge between the end walls 6 and 8 and slidably support the drive block 28, and further prevent rotation of the drive block upon rotation of the lead screw 24 by the stepping motor 12. As a result, rotation of the lead screw 24 traverses the guide block slidably along the guide rails 32*a* and 34*a*. The stepping motor 12, the coupler 18, the lead screw 20, and the guide block 28 are the primary components of a stepping motor drive for the apparatus 1. Also as shown in FIGS. 2 and 5 is a plate form cover 36 having depending integral sidewalls 38. The cover 36 is supported on the end walls 6 and 8, and cooperates with the base 4 to form a housing which encloses the component parts of the stepping motor drive.

As shown more particularly in FIGS. 3 and 5 a work station in the form of an anvil is generally illustrated at 40 having a machined work surface 42 for stably supporting an electrical connector, as will be explained hereinafter. The anvil 40 is an elongated, stiff cantilever beam which is tapered lengthwise and joined at its most massive end to a transverse, generally triangular mounting plate 44 which is integral with an elongated rectangular boss 46 positioned transversely of one end of the anvil 40 and above the work surface 42.

Figure 7:
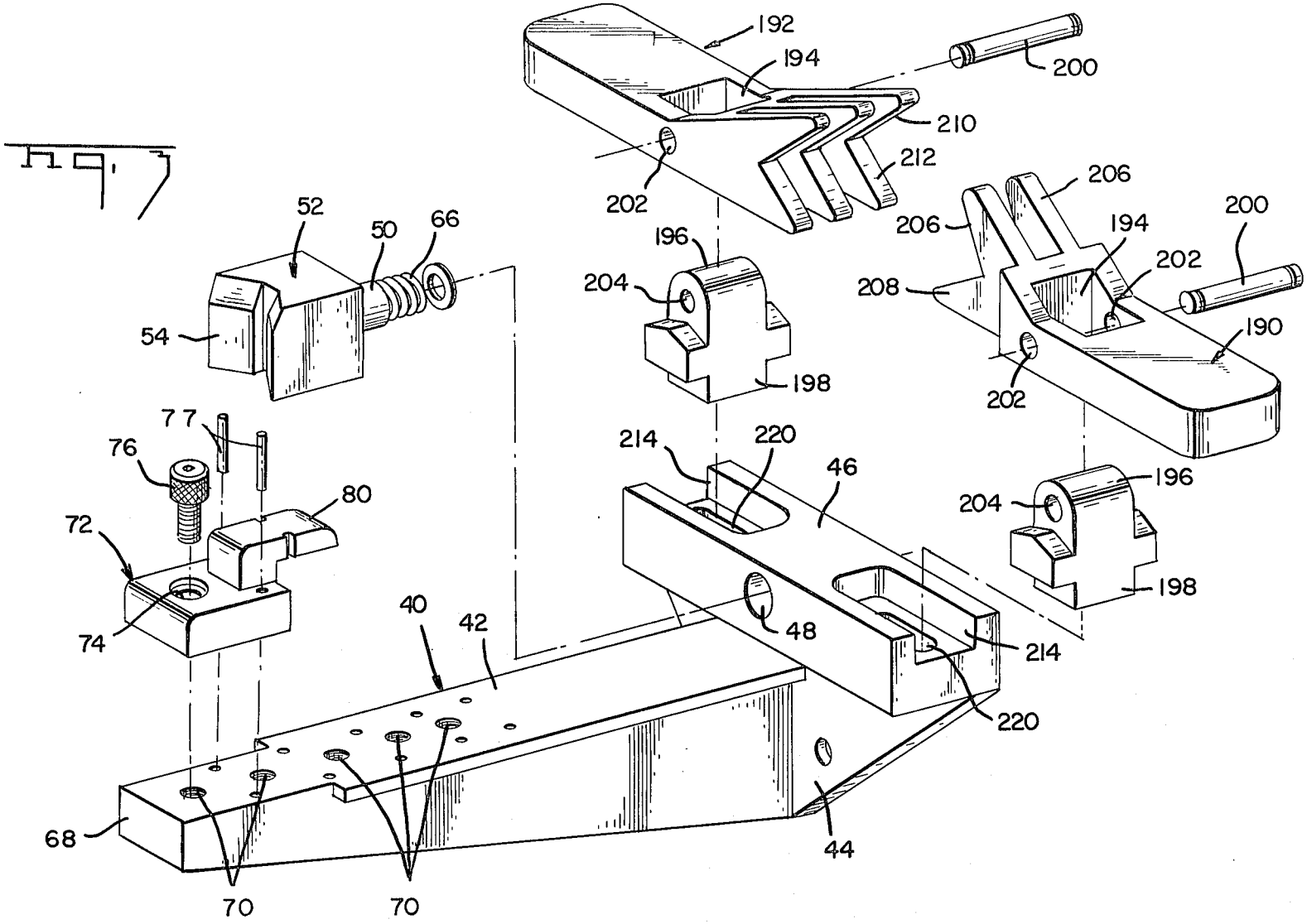
FIG. 7 is an enlarged elevation partially in section of the anvil illustrating an electrical connector being mounted thereon and retained in place by heel blocks.

As shown more particularly in FIGS. 3, 7, and 8, the boss 46 includes a relatively deep counter bore 48 in elongated alignment with the work surface 42 in which is freely received a cylindrical stem 50 of a heel block 52. The heel block 52 is slidably supported on the work surface 42 and is provided with a generally concave vertical sidewall 54 which projects above the work surface 42 at one end thereof. A machine screw 56 has the enlarged head thereof recessed in another counter bore 58 of the mounting boss 46. The shaft 60 in the screw projects through an opening 62 in a web 64 separating the counter bores 48 and 58. The threaded end 64 of the shaft 60 is threadably received in the stem 50. A coil spring 66 is further received over the shaft 60 and is compressed between the stem 50 and thd web 64 to provide a biasing force tending to push the heel block 52 away from the mounting boss 46.

The free end 68 of the anvil 40 is provided with a series of internally threaded vertical recesses 70 which are spaced lengthwise of the work surface 42. Another heel block 72 includes a vertical bore 74, through which passes a machine screw 76, which is threadably received selectively in one of the recesses 70 to thereby mount the heel block 72 in a selected fixed position along the work surface 42. A pair of dowel pins 77 are also provided for purposes of alignment. The heel block 72 further is provided with a bearing surface 78 which projects outwardly from the work surface 42 in spaced opposed relationship with the concave bearing surface 54 of the other heel block 52. An integral keeper flange 80 is provided on the heel block 72 to provide a catch, in spaced relationship from the work surface 42, adjacent the bearing surface 78. An electrical connector is illustrated generally at 82 and includes a first row of slotted plate type contacts 84 and an oppositely facing, second row of similar contacts 86. The details of the connector and the contacts thereof are disclosed more particularly in U.S. Pat. No. 3,760,335. Alongside each row of contacts 84 and 86 is provided a corresponding elongated flange portion 88 of the connector 82. The top horizontal surface of each flange 88 is precisely located with respect to each of the contacts 84 and 86 in their respective rows thereof, and also successively passes alongside the corresponding row of successively arranged contacts 84 and 86. The connector 82 is mounted on the work surface 42 by an operator, first positioning one end 90 of the connector under the keeper flange 80 and pivoting the connector opposite end 92 in the direction shown by the arrow 94 in FIG. 7. The end 92 will thereby slidably impinge against and within the concave surface 54, forcing the heel block 52 slidably along the work surface 42 toward the boss 46 in opposition to the resilient biasing force of the coil spring 66. This will allow the end 92 to slidably traverse vertically along the bearing surface 54 in order to bring the lengthwise bottom surface 96 of the connector in stable registration against the work surface 42. The coil spring 66 will be compressed somewhat and will urge or bias the heel block 52 tightly against the connector end 92. This will cause the opposite end 90 of the connector to be impinged against the keeper flange 80 of the heel block 72, whereby the connector is mounted in stationary position on the work surface 42 of the anvil 40.

The anvil 40 is mounted to the base 4 as shown in FIGS. 5 and 7. More particularly, the flange 44 is mounted to the external surface of the end wall 8, for example, by screws passing through the flange and threadably secured in the wall 8. The anvil 42 thus will project longitudinally parallel with the lead screw 30. Depending upon the direction of rotation of the lead screw, the drive block 28 will be transported toward or away from the anvil 42.

Figure 4:
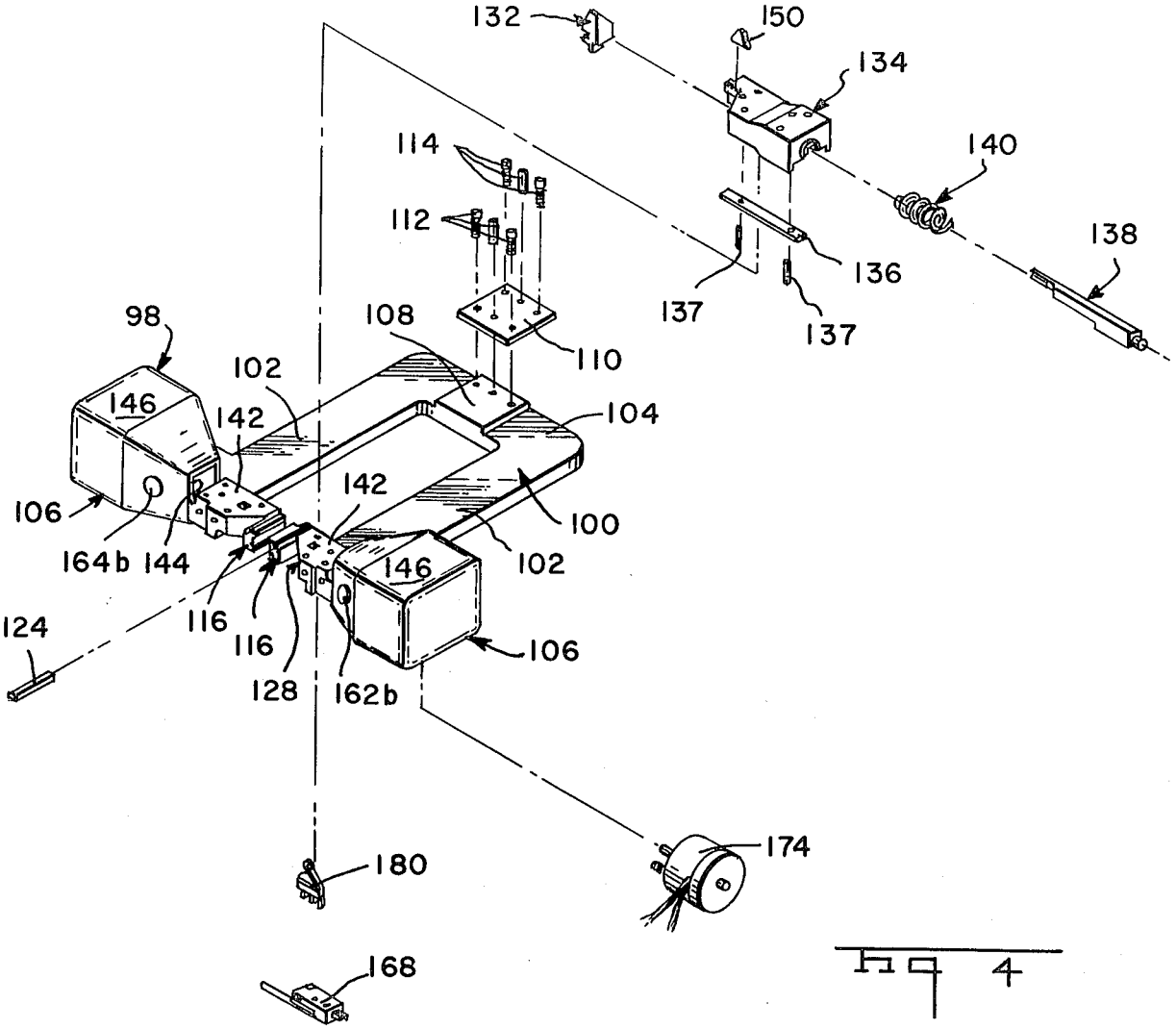
FIG. 4 is a perspective in exploded configuration of a readily replaceable unit including a carriage and inserter tooling.

A salient feature of the invention resides in a quickly removable tooling unit for wire trimming and inserting. Since each connector may require different wire trimming and inserting tooling, it is most advantageous to provide for quick replacement of the tooling which is tailored for the specific type of connector selected for use in the apparatus according to the invention. A typical removable tooling unit is shown in FIG. 4 generally at 98 which includes a generally U-shaped plate 100 or yoke having elongated, parallel spaced arm portions 102 integrally joined by a base portion 104. Mounted at the ends of the arm portions 102 are an opposed pair of wire trimming and inserting tooling subassemblies, illustrated generally at 106 and explained in detail hereinafter. The base portion 104 is provided thereon with a central boss 108. A gusset plate 110 is shown in FIG. 4, which is secured to the boss 108 by threaded fasteners 112. The gusset plate 110 removably secures the tooling unit 98 to the drive block 28, as shown more particularly in FIG. 5. In the figure, the yoke 100 partially overlies the end wall 8 and a portion of the lead screw 20. The base 104 of the yoke is directly opposite the drive block 28. The gusset plate 100 overlies or bridges across between the base portion 104 and the block 28, and may be removably secured to the drive block 28 by threaded fasteners 114. The cover 36 will overlie the base portion 104 and the gusset plate 110, as well as the drive block 28. With the yoke 100 thus mounted in the apparatus, the yoke will project outwardly beyond the end wall 8 and position the pair of tooling subassemblies 106 adjacent opposite sides of the anvil 42.

The relationship between the tooling and the anvil is shown more particularly in FIGS. 4, 9, and 10. FIG. 4 illustrates the tooling subassemblies 106 having closely adjacent shoes 116 which are to be positioned on either side of the anvil 42 in a manner to be described. FIG. 10 illustrates more in detail one of the shoes 116. In the figure, the shoe 116 is provided with a horizontal grooved track 118 which freely receives therein a laterally projecting rail 120 which is integral and flush with the work surface 42 of the anvil 40. As the lead screw 30 is rotated to transport the drive block 28 and the yoke 100, the shoe 116 will slidably traverse along the rail 120 of the anvil 40. The tooling subassembly 106 accordingly is not permanently mounted to the work surface 42 on which the connector 82 is supported, but is readily, removably disengaged therefrom without a need for manipulating fasteners or the like. In addition, the groove 118 is enlarged in width which allows the shoe 116 to be lifted slightly with respect to the anvil 40 and to ride up and along a connector mounted on the work surface 42.

More particularly, FIG. 9 illustrates the position of both shoes 116 initially resting on either side of the work surface 42 adjacent the anvil free end 68. The keeper flange 80 of the heel block 72 initially is disposed between the shoes 116 with a substantial remainder of the work surface 42 thereby exposed, permitting an operator to mount a connector on the work surface 42 and under the keeper flange 80. Thus, the initial position of the yoke 100 with respect to the anvil 40, is a connector loading position with the yoke shoes 116 resting on the anvil. Such position is achieved when the yoke 100 is fully projecting outwardly of the end wall 8 and when the drive block 28 is transported to a furthest permissible distance from the stepping motor 12.

Figure 11:
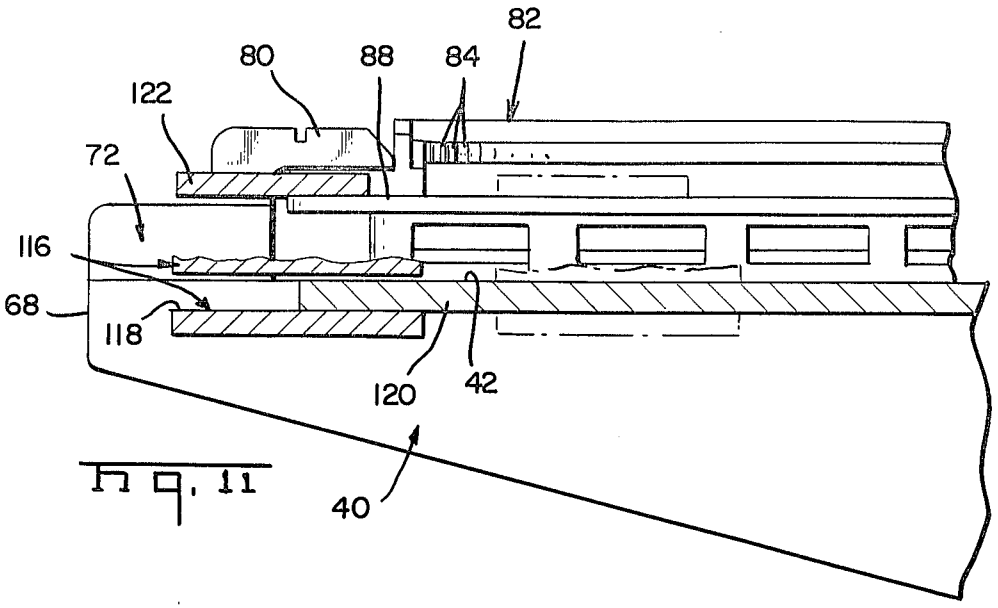
FIG. 11 is an enlarged fragmentary elevation partially in section of the anvil having mounted thereon an electrical connector, and having a portion of the carriage illustrated in FIG. 10 bearing against a reference surface of the connector upon transport of the carriage along the connector.
Figure 6:
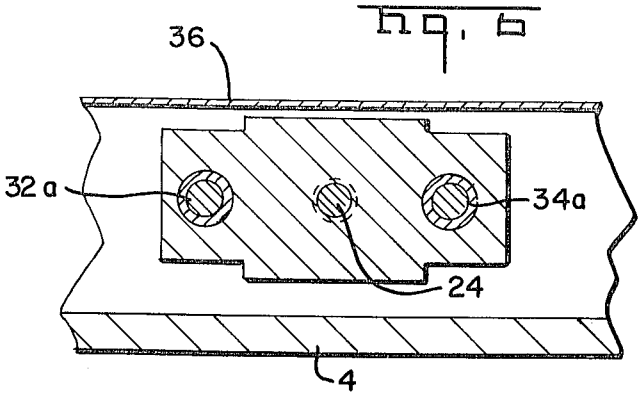
FIG. 6 is a section taken along the lines 6—6 of FIG. 5 in illustrating a drive block portion of the stepping motor drive.
Figure 7:
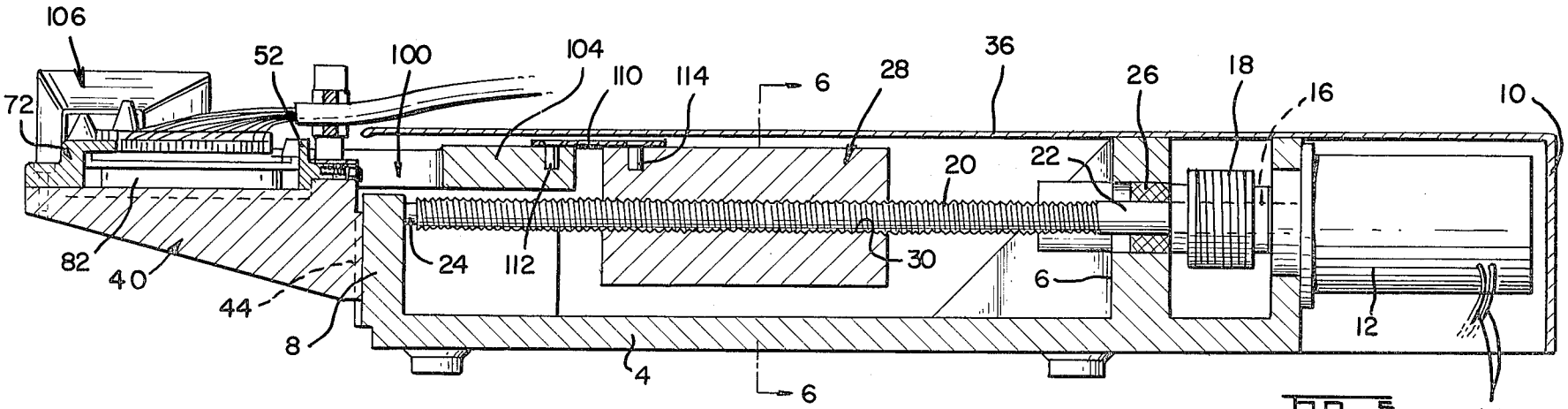
Figure 6:
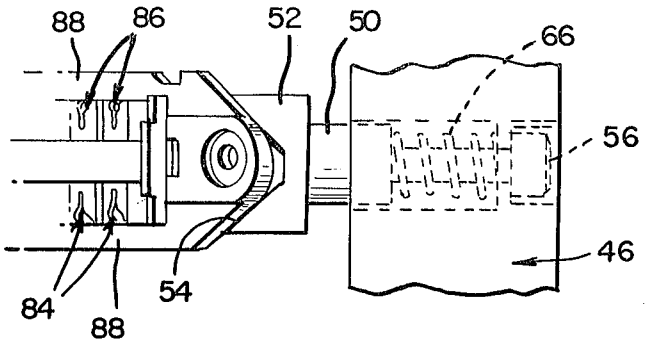
Figure 7:
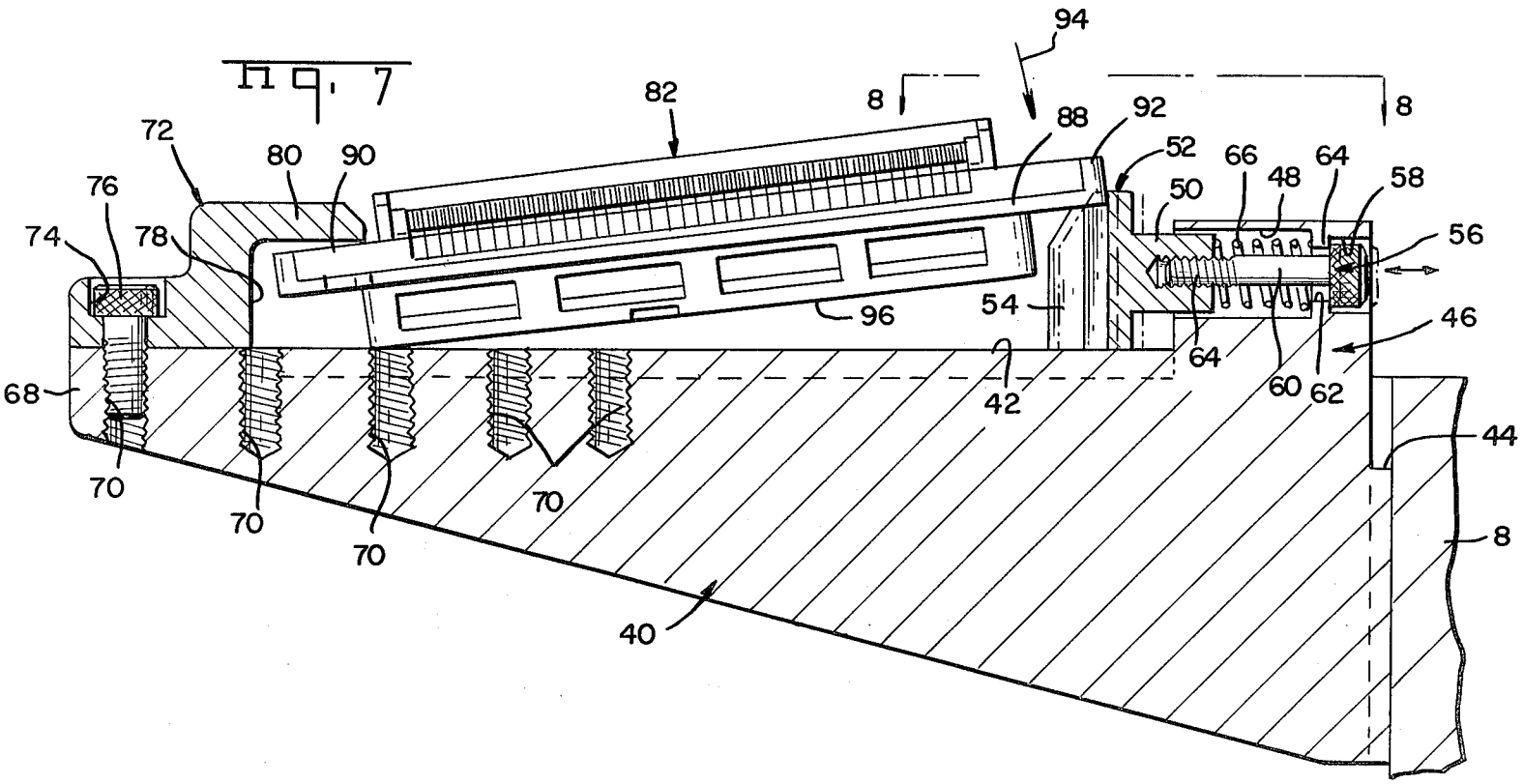

As shown in FIG. 10, each shoe 116 is provided with a horizontally projecting rib 122 in parallel spaced relationship with the groove 118. FIG. 11 illustrates shoe 116 displaced slightly along the anvil away from the free end 68. With an exemplary connector 82 in place, such displacement will draw each flange 122 along the sides of the connector to overlie a corresponding flange 88. Each flange 122 will thereby be seated or rested upon a corresponding flange 88, whereby each shoe 116 is slightly elevated or lifted from a corresponding rail 120 of the anvil 40. Thereby the weight of the tooling 106 is fully supported on the flanges 88 of the connector 82. The connector flanges 88 successively follows the rows of contacts 84, and 86 and are precisely spaced an equal amount vertically from each of the contacts. The connector is fabricated by molding an insulative plastic material. Subsequently, the electrical contacts are assembled in two rows within the connector. Desirably, the connector is molded with supports for the rows of contacts, the supports being in straight paths. Sometimes, however, as the plastic material solidifies during the molding operation the connector will warp slightly and thereby will become slightly curved in its longitudinal dimension. The rows of supports for the contacts, in the longitudinal dimension, will also appear to be slightly curved. The rows of contacts when assembled in the connector, also will appear to have a corresponding curvature. Heretofore, it has been difficult to repeatedly align wire insertion tooling with successive contacts, since curvature of the rows of contacts would shift the contacts out of expected locations, and the amount of shift was unpredictable and uncontrolled. If the insertion tooling was incorrectly aligned with a contact, the contact would be struck and damaged upon an attempt by the tooling to forcibly insert a wire.

It has been found that warpage of the connector in the longitudinal direction will cause curvature of the rows of supports for the rows of contacts and also a corresponding curvature of each of the flanges 88. The curvature of the flanges 88 was observed to be consistent with the curvature of the rows of contacts. Thus, the flanges 122, by impingement against and along the curvature of the flanges 88, if curvature is present or not, will precisely position the corresponding tooling subassemblies 106 with respect to individual contacts 84 and 86. Additionally, the weight of the tooling unit on the flanges 88 will fixedly retain the connector 82 stably in position on the work surface 42 during the subsequent wire trimming and insertion operations.

The nature of the tooling for wire trimming and inserting will be described. FIG. 10 and FIG. 4 illustrate a rectangular cutter bar 124 mounted in a groove 126 of each shoe 116. Each shoe 116 further is provided with a tapered recessed sidewall 128 which forms a wire-receiving passageway having an end portion 130 which communicates with the groove 126. A wire, which is inserted along the passageway until reaching the end 130 of the passageway 128, will be impinged against the cutter bar 124 which is used to shear through or trim the wire in a manner to be described.

Additional component parts of each tooling subassembly 106 are illustrated generally in FIG. 4 and include, a generally pyramidal shaped cusp 132, an anvil block 134, an elongated wire gripping blade 136, which is mounted internally of the block anvil 134, and an elongated wire insertion finger 138, which is mounted in the corresponding tooling assembly 106 for reciprocation internally of the block 134. The finger 138 is resiliently biased by a coil spring 140 received thereover.

Figure 12:
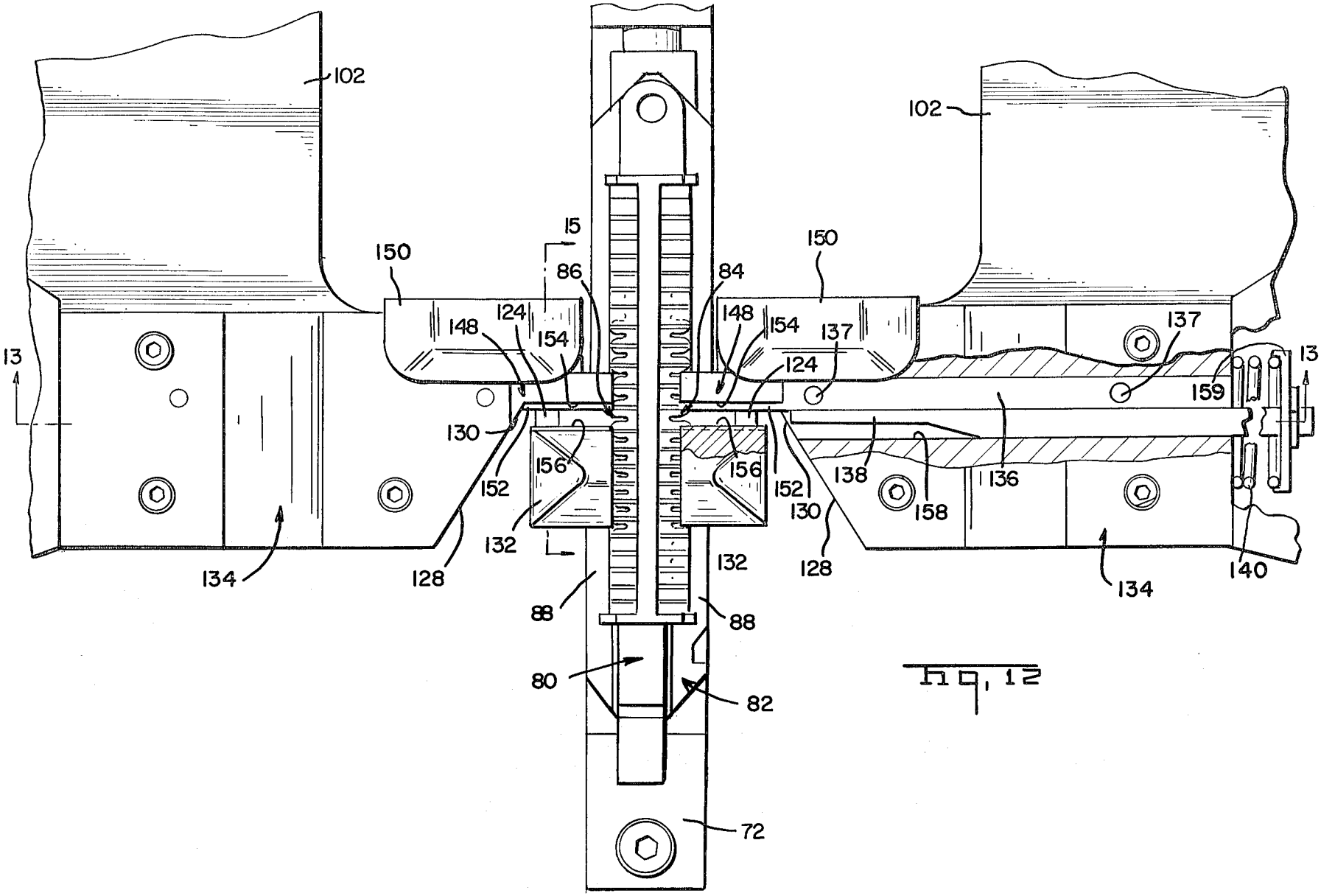
FIG. 12 is a fragmentary plan view of a portion of the device illustrated in FIG. 11 illustrating the carriage being successively advanced along the reference surface of the connector.

The component parts of each tooling subassembly is assembled as shown in FIGS. 12 and 13, in conjunction with FIGS. 4 and 10. More particularly, FIGS. 4 and 10 illustrate each shoe 116 as having a relatively large planar platform 142 above which projects an open end 144 of an enlarged housing 146 having a hollow interior which opens out onto the platform 142.

Figure 15:
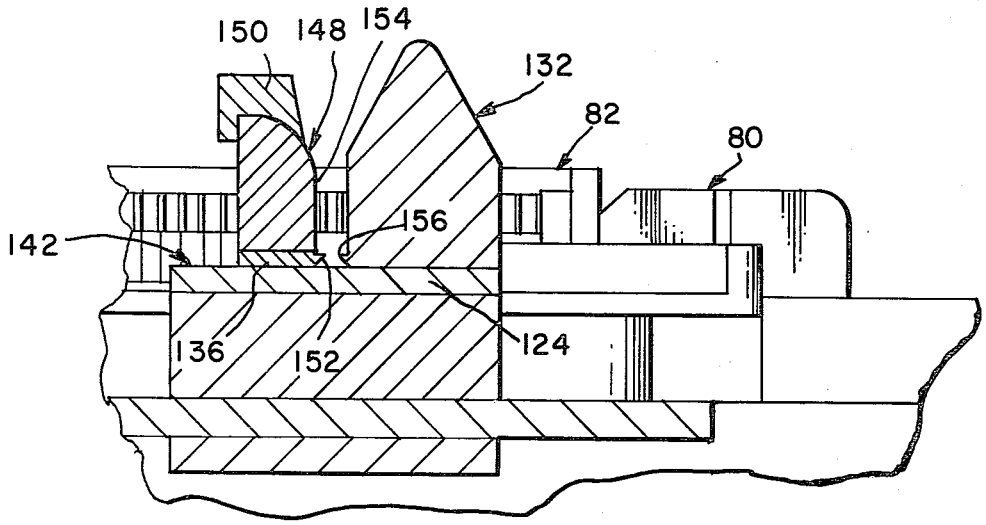
FIGS. 15 and 16 are enlarged fragmentary elevations in section of the wire trimming and insertion tooling of FIG. 12 illustrating retention and guiding of a trimmed wire during insertion thereof into a corresponding electrical contact of the connector mounted on the anvil.

As shown in FIGS. 12 and 13, each block 134 is mounted on a corresponding platform 142. Each further is configured with a sidewall which conforms to the wire-receiving passageway 128 and the end portion 130 of the passageway. At each passageway end portion 130 the wire anvil is provided with a rounded wire-receiving anvil 148 above which projects a boss 150 which provides a back stop or barrier vertically above at least a portion of the anvil 148. FIG. 15 more particularly illustrates one anvil 148 and boss 150 in detail. Also, with reference to FIG. 12, in conjunction with FIG. 15, a corresponding wire gripping blade 136 includes a portion which extends along and under the wire-receiving anvil 148. A sharpened elongated edge 152 of the blade 136 projects outwardly into a narrow channel 154 defined between the anvil 148 and one cusp 132 which is also mounted to the platform 142. The cusp 132 further includes a projecting elongated chisel edge 156 along one side of the channel 154 directly opposite the chisel edge 152. FIG. 12 illustrates that each blade edge 152 and the corresponding cusp edge 156 extends from the corresponding portion 130 of the wire-receiving passageway 138 to a corresponding contact 84 or 86 in their respective rows of contacts. The figure further illustrates one of the insertion fingers 138 being slidably mounted in a channel 158 in the anvil block 134, with the coil spring 140 over the finger and captivated between the block 134 and a clip washer 159 secured on the finger. The finger 138 will slidably traverse along the channel 158, first, entering the end portion 130 of the wire-receiving passageway and impinge against a wire received therein. Continued traverse of the finger 138 will force the wire along the wire-receiving channel 154 and over the cutter bar 124 which trims the wire. The trimmed wire will continue along the channel 154 while it is gripped on opposite sides by the chisel edges 152 and 156 until the wire is inserted into a corresponding contact 84.

Figure 14:
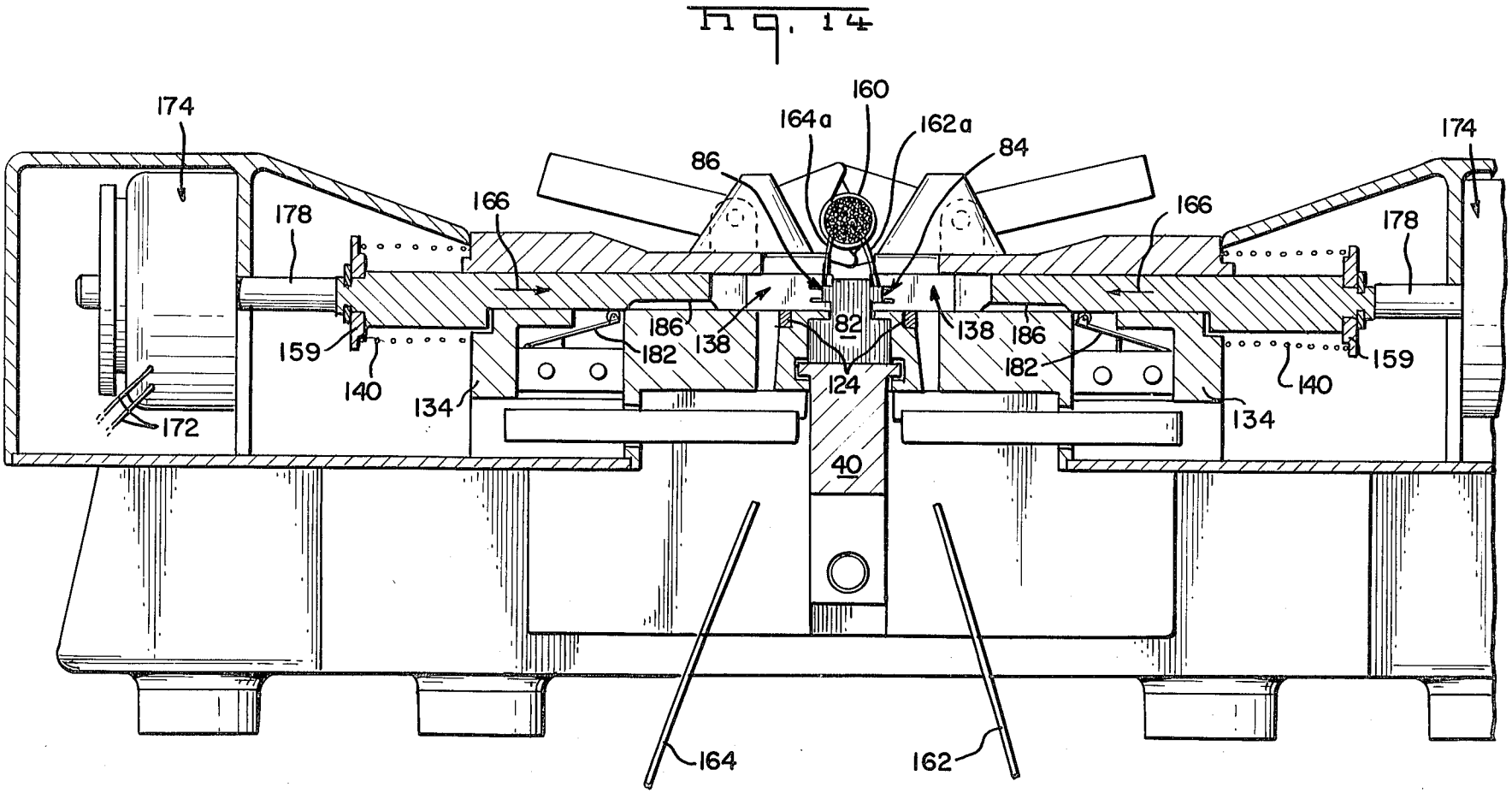
FIG. 14 is a view similar to FIG. 13 illustrating actuation of the wire trimming and inserting tooling whereby the illustrated pair of wires are trimmed and inserted into corresponding electrical contacts of a connector mounted on the anvil.

The wire insertion operations are shown in FIGS. 13 and 14. A circular end of a multiple wire cable 160 also is illustrated. The operator selects a pair of wires from the cable, grasping the ends of the wires 162 and 164, one in each hand. The wires are presented to the wire-receiving passageways 128 to the ends 130 thereof as shown in FIG. 13. The wires will then extend from the cable 160 and be draped vertically over the wire-receiving anvils 148, and from there, vertically downward through the end portions 130 of the wire-receiving passageways. The grasped wire ends 162 and 164 will then be on either side of the work station anvil 40, and will extend outwardly below the tooling subassemblies 106.

FIG. 14 illustrates sliding traverse of the corresponding insertion fingers 138 in the direction of the arrows 166, the ends of the fingers thereby first impinging corresponding wires 162 and 164, forcing them to traverse along the corresponding channels 154 as described in conjunction with FIG. 12. In so doing, the wires 162 and 164 are first forced over the cutter bars 124 whereby the grasped ends 162 and 164 of the wires are cut off, at the intersection of the fingers and the cutter bars, and then discarded by an operator. The trimmed wires are illustrated at **162*a* and 164*a* and are continued to be transported along the channels 154, by further traverse of the insertion fingers 138, until inserted into corresponding contacts 84 and 86**.

Figure 16:
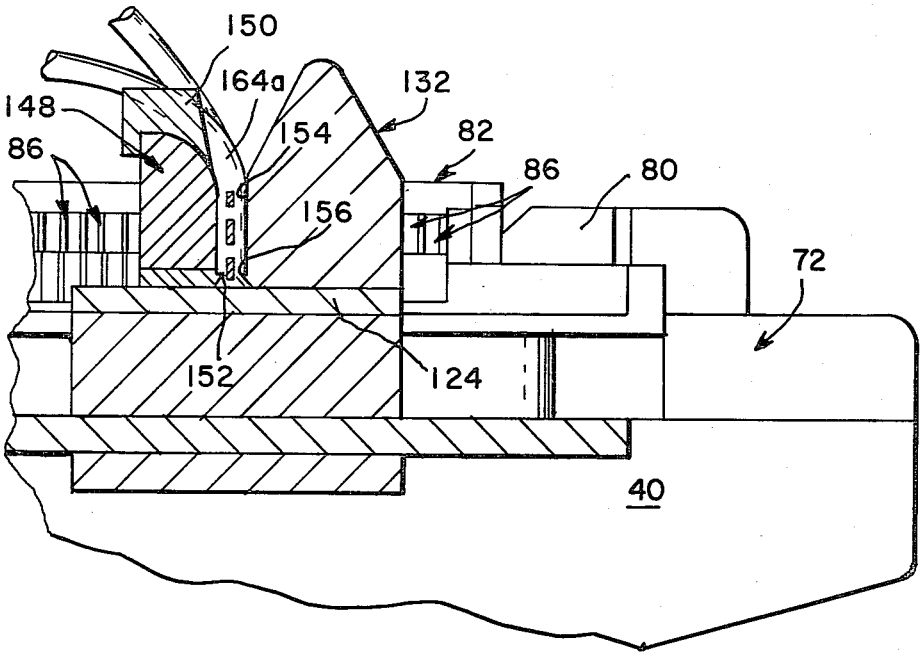
Figure 17:
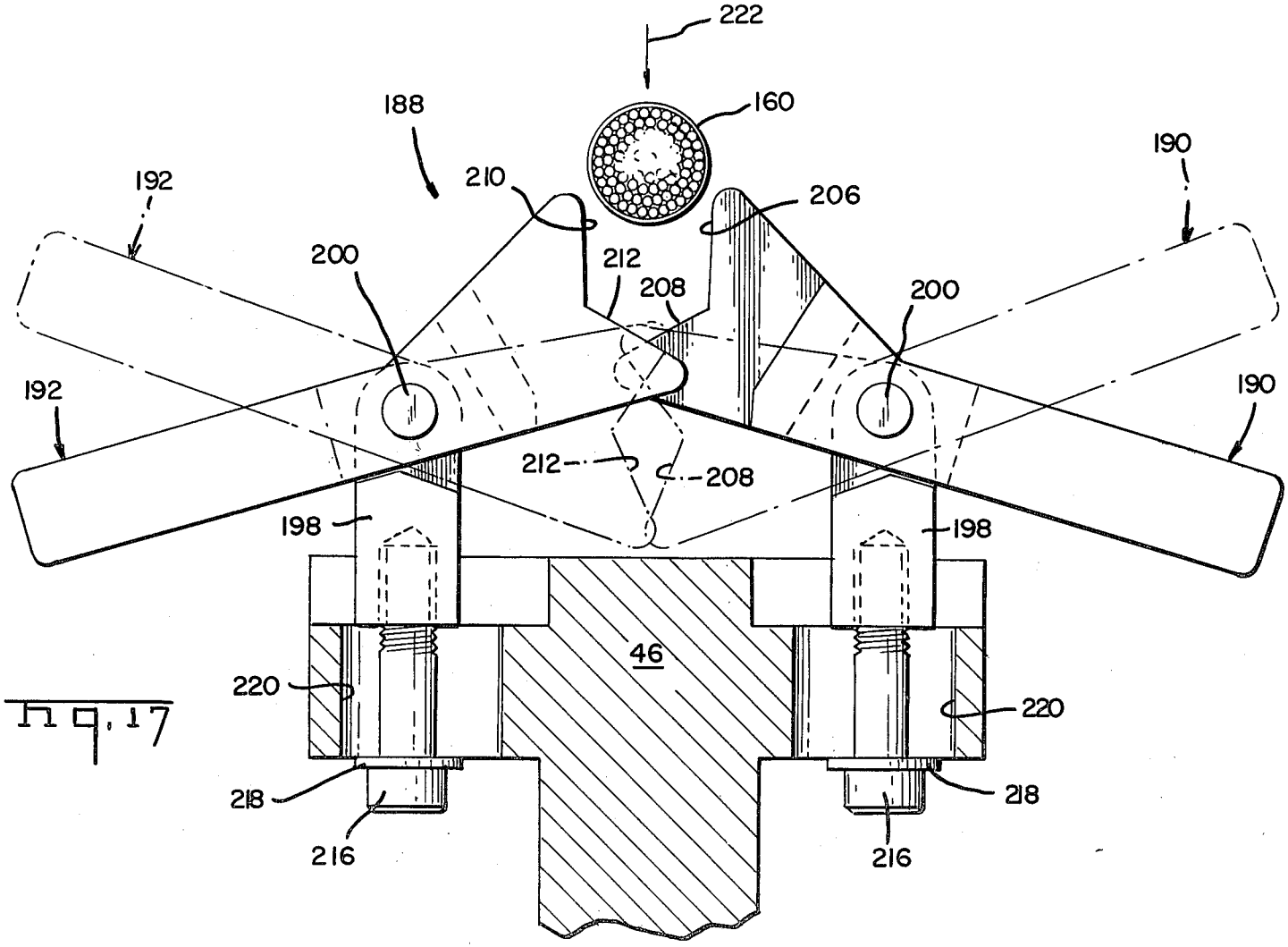

The trimmed wires **162*a* and 164*a* are prevented from escaping out of the channels 154. More particularly, as shown in FIG. 16, the wire 164*a* while in the channel 154, will be gripped on either side by the chisel edges 152 and 156. The chisel edges will slice through the insulation of the wire. However, this will not be detrimental since the damage to the wire is confined so closely to the trimmed end thereof that it will be external to that portion of the wire which is connected electrically and mechanically to the corresponding electrical contact 86**.

Electrical components will be described with reference to FIGS. 18, 13, and 14. Each subassembly 106 includes a corresponding lever actuated switch 168 having the actuation lever 170 thereof in communication with a wire-receiving passageway end portion 130. As shown in FIG. 13, the corresponding wire end portions 162 and 164 will engage and pivot corresponding levers 170 to actuate the switches 168 and allow passage of electrical current over the electrical leads 172 of each solenoid 174 and 176 which is mounted to an internal wall 177 of a respective housing 146. The armature 178 of each solenoid impinges against a corresponding insertion finger 138. The armatures 178 will be propelled outwardly of the solenoids upon the supply of current thereto, forcibly impelling the corresponding fingers 138 in the direction of the arrows 166 of FIG. 14. The corresponding coil springs 140 will be compressed between the washers 159 and the blocks 134. Upon cessation of the armature stroke, the coil springs will expand and thereby return the corresponding fingers 138 and armatures 178 to their original positions shown in FIG. 13. Each solenoid 174 is a single action type with a return stroke being provided by expansion of the compressed coil spring 140. The switches 168 and the solenoids 174 and 176 are electrically connected such that both switches 168 must be activated to prevent one solenoid from being activated without the other. This will prevent the possibility of one trimmed wire being inserted without the other.

On occasion it may be desirable to insert only one wire. Thereby, a pair of manually operated push button switches **162*b* and 164*b* are provided on a respective housing 146. If only the wire 152 is presented for insertion, an operator will hold the wire in the end portion 130 of the wire-receiving passageway, with his right hand. With his left hand, the operator will depress the button switch 164*b*. The switch will activate the solenoid 176 simultaneously upon actuation of the solenoid 174 by the presence of the wire 162. In similar fashion, if only the wire 164 is presented, the operator normally holds the wire in his left hand and with his right hand depresses the push button switch 162*b* that activates the solenoid 176 simultaneously with actuation of the solenoid 174 by the wire 164**.

Figure 18:
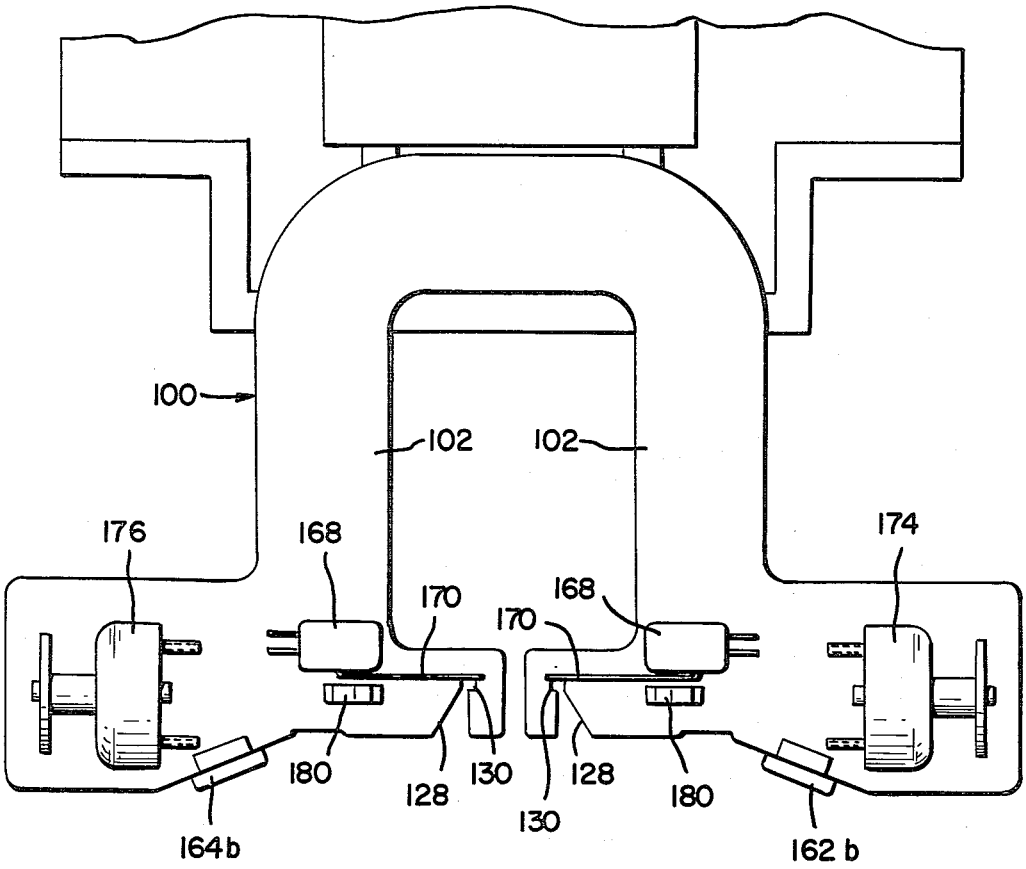
FIG. 18 is a schematic view of the removable carriage according to the present invention illustrating the locations of electrical switches which activate wire trimming and insertion, as well as, successive transport of the carriage.

FIGS. 13 and 18 further illustrate a pair of lever actuated switches 180, each mounted in a corresponding shoe 116 (FIG. 10) and having an actuation lever 182 thereof projecting above the platform 142 through an opening 184 provided therein. Each lever 182 has an enlarged ball tip which initially engages in a recess 186 provided in each insertion finger 138. When each finger 138 is displaced by actuation of the corresponding solenoid, the recess 186 will be displaced relative to the lever 182. A thicker portion of a corresponding finger 138 will then engage the lever 182 and deflect the same. As the thicker portion goes completely past the lever 182, the lever will be released and will spring back, thereby activating a corresponding switch 180. Both switches 180 when activated supply a signal to circuitry (not shown) which controls the supply of current over the electrical leads 14 to the stepping motor 12. Such supply of current will drive the stepping motor a precise amount which, in turn, will rotate the lead screw and transport the drive block and the tooling unit 98 a precise distance, to align the tooling subassemblies 106 with the next successive contacts 84 and 86 in preparation for insertion of trimmed electrical wires therein. The circuit may be any type which is well known to an artisan and need not be explained in detail. The recess 186 is positioned so that actuation of both switches 180 occurs when the insertion fingers 138 have completed their insertion strokes and are in the process of being removed away from the contacts 84 and 86 by expansion of the coil springs 140. It is further desirable that both switches 180 be activated to activate the stepping motor.

Figure 17:
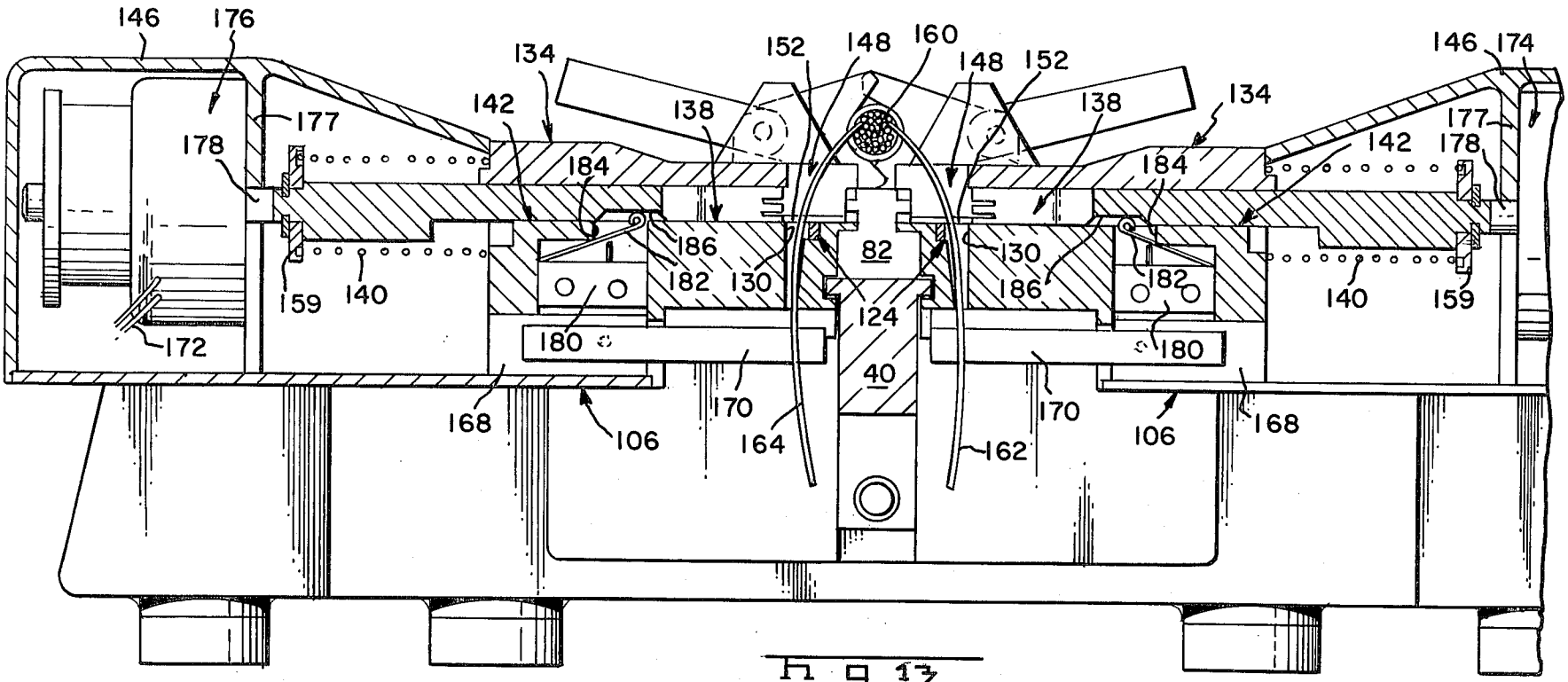
FIG. 17 is an enlarged elevation partially in section of a cable clamp for the apparatus according to the present invention.

A cable clamp according to the present invention is generally indicated at 188 in FIGS. 17 and 3. The clamp includes a pair of levers 190 and 192, each having vertical openings 194 received over arcuate ends 196 of corresponding mounting blocks 198. Corresponding pivot pins 200 pass through apertures 202 in the levers and through apertures 204 in the mounting blocks 198, whereby the levers are pivotally mounted on the blocks 198. The lever 190 is provided with a cable gripping jaw divided into horizontally spaced segments each having a diverging upper jaw portion 206 and a diverging lower jaw portion 208. In similar fashion, the lever 192 is provided with a cable gripping jaw divided into a plurality of segments each having a diverging upper jaw portion 210 and a diverging lower jaw portion 212. The jaw segments of the lever 190 are interdigitated with respect to jaw segments of the lever 192. To complete the assembly, the mounting blocks 198 are adjustably located along channels 214 provided in the boss 46. As shown in FIG. 17, the blocks 198 are secured in place by cap screws 216 passing through enlarged washers 218 which span across relatively narrow slots 220 provided in the bottom of the channels 214. The levers 190 and 192 counter balance the jaws, initially opening the jaws as shown in FIG. 17, with the top jaw portions 206 and 210 defining therebetween a top accessible space into which a length of cable 160 is received. The cable is inserted by being urged vertically downward in the direction of the arrow 222, whereby the cable bears against the lower jaw portions 208 and 212, forcing the jaws and the levers thereof to pivot about the pins 200 to the positions shown in phantom outline. Such action will cause the top jaw portions 206 and 210 to converge toward one another narrowing the space therebetween. The cable 160 thereby will be wedgingly gripped and substantially encircled by the jaw portions 206, 208, 210, and 212. Additionally, the jaws will become wedged between the pivots 200 and the cable 160 to remain fixedly in their phantom outline positions. The cable 116 may be removed from the jaws merely upon an operator grasping and drawing the same vertically upward in a direction opposite the arrow 222, which will overcome the frictional retention on the cable and forcibly pivot the jaws to their initial positions shown in FIG. 17. When the individual wires of the cable 160 are trimmed and inserted in the contacts 84 and 86 of the connector 82, the tooling unit is returned by the stepping motor drive to the connector loading position shown in FIG. 9, and the connector and the cable 160 may be drawn vertically and thereby removed as a unit, the connector being drawn vertically outwardly of the heel blocks 52 and 72, overcoming the frictional retention provided thereby.

The heel blocks 72 and 52 are readily removable from the apparatus for replacement by heel blocks of different configurations in order to accept different types of connectors on the work surface 42. In addition, the heel block 72 is adjustably mounted by the screw 76 in any of a plurality of positions to adapt to connectors of different lengths. The tooling unit 98 is readily removed for replacement by tooling of a type tailored specifically for wire trimming and insertion into a connector of any selected type. Removal of the tooling unit 98 is accomplished by unfastening the fasteners 112 or 114 and by slidably removing the shoes 116 from the anvil rails 120.

Although a preferred embodiment of the present invention is disclosed and shown in detail, other modifications and embodiments thereof which are apparent to one having ordinary skill in the art is intended to be covered by the spirit and scope of the appended claims.

What is claimed is:

1. In apparatus, having an anvil for mounting an electrical connector, tooling for trimming and inserting electrical wires of a multiple wire cable into successively arranged electrical contacts contained in an electrical connector mounted on said anvil, and a stepping motor drive for transporting and repeatedly stopping the tooling successively in alignment with the contacts preparatory to insertion of corresponding trimmed wires therein, the improvement comprising:

a carriage fixedly mounting said tooling thereon, said carriage and said tooling being connected as a unit to said stepping motor drive and being transported by said stepping motor drive as a unit along an electrical connector mounted on said anvil, said carriage engages said anvil before and after mounting of an electrical connector thereon, and said carriage includes means for engaging and following a reference surface of said connector during transport along said connector and during precise alignment of said tooling with each successive contact in said electrical connector during wire trimming and insertion of a trimmed wire into each successive contact.

2. The improvement as recited in claim 1, wherein, said carriage and said tooling are removably fastened as a unit to said stepping motor drive, said carriage is slidably engaged on said anvil, said carriage and said tooling are readily unfastened as a unit from said stepping motor drive, and said carriage is slidably separable from said anvil without having been fastened thereto.

3. The improvement as recited in claim 1 and further including:

first means applying horizontal friction forces on an electrical connector for frictionally retaining the same on said anvil, and second means applying horizontal friction forces on a multiwire cable for frictionally retaining said multiwire cable in position adjacent said anvil, said first and second means being open in a vertical direction so that said cable and said electrical connector are removable as a unit by drawing the same vertically from said first and second means, overcoming the horizontal frictional retention provided thereby.

4. The improvement as recited in claim 3, wherein, said second means includes a pair of opposed jaws mounted on pivots and initially positioned to define a vertically open cable receiving space therebetween, said jaws being pivotable about said pivots to become wedged between a received cable and said pivots, thereby to frictionally retain said cable, said cable being removable by drawing the same vertically from said jaws, pivoting the jaws to their initial positions and overcoming the frictional retention provided thereby.

5. In apparatus having an anvil for mounting an electrical connector, tooling for trimming and inserting electrical wires of a multiple wire cable into successively arranged electrical contacts contained in an electrical connector mounted on said anvil and a stepping motor drive for transporting and repeatedly stopping the tooling successively in alignment with the contacts preparatory to insertion of corresponding trimmed wires therein, the improvement comprising:

a carriage fixedly mounting said tooling thereon, said carriage and said tooling are connected as a unit to said stepping motor drive and are transported by said stepping motor drive as a unit along an electrical connector mounted on said anvil, and said carriage includes means which engages and follows a reference surface of said connector for alignment of said tooling in precise alignment with each successive contact in said electrical connector during wire trimming and insertion of a trimmed wire into each successive contact.

6. The improvement as recited in claim 5, wherein, said tooling includes:

means defining a wire receiving channel in alignment with an electrical contact in an electrical connector mounted on said anvil, cutter means in alignment with said channel for trimming an electrical wire transported over said cutter means, gripping means in said wire receiving channel for grippingly engaging the trimmed end portion of an electrical wire transported along said channel, and insertion means traversible along said channel for engaging and transporting an electrical wire serially over said cutter means and along said channel, while engaged by said gripping means, and into said contact.

7. The improvement as recited in claim 6, wherein, said tooling further includes:

drive means for supplying power to transport said insertion means along said channel, and trigger switch means for activating said drive means, said trigger switch means being in alignment with said channel and triggered by said wire positioned in alignment with said channel prior to transport thereof over said cutter means.

8. The improvement as recited in claim 7, wherein, said drive means comprises an electrically powered solenoid having a reciprocating armature, said insertion means comprises an insertion finger mounted for reciprocation with said armature, and said trigger switch means comprises a lever actuated electrical switch connected in an electrical circuit with said solenoid and a source of electrical power, said lever being positioned in alignment with said channel for engagement by said wire positioned in alignment with said channel prior to transport over said cutter means.

9. The improvement as recited in claim 5, wherein, said tooling includes:

first means defining a wire receiving passageway receiving an untrimmed electrical wire therein, second means defining a wire receiving channel intersecting said passageway and in alignment with an electrical contact of an electrical connector mounted on said anvil, cutter means aligned with said channel for engaging and trimming said electrical wire upon transport thereof from said passageway into engagement with said cutter means and along said channel, gripping means in and along opposite sides of said channel and extending from said cutter means toward said electrical contact for grippingly engaging opposite sides of said electrical wire adjacent a trimmed end thereof during transport of said wire along said channel, insertion means transportable through said passageway and along said channel for engaging said wire and transporting said wire from said passageway into engagement with said cutter blade, along said channel, while engaged by said gripping means, and into said electrical contact.

10. The improvement as recited in claim 9, and further comprising:

drive means for supplying power to transport said insertion means through said passageway and along said channel, and trigger switch means for activating said drive means, said trigger switch means being within said passageway and triggered by said untrimmed wire while the same is positioned within said passageway and in alignment with said channel.

11. The improvement as recited in claim 10, wherein, said drive means comprises an electrically powered solenoid having a reciprocating armature, said insertion means comprises an insertion finger mounted for reciprocation with said armature, and said trigger switch means comprises a lever actuated electrical switch connected in an electrical circuit with said solenoid and a source of electrical power, said lever being in alignment with said passageway for engagement by said untrimmed wire in said passageway.

* * * * *